United States Patent [19]

Hunter et al.

[11] 4,136,780

[45] Jan. 30, 1979

[54] MAIL SINGULATION AND CULLING SYSTEM

[75] Inventors: James R. Hunter, Chadds Ford; Sebastian J. Lazzarotti; Robert S. Bradshaw, both of Broomall, all of Pa.

[73] Assignee: Burroughs Corporation, Detroit, Mich.

[21] Appl. No.: 864,258

[22] Filed: Dec. 27, 1977

[51] Int. Cl.[2] ..... B07C 5/00; B07C 5/344

[52] U.S. Cl. ..... 209/539; 209/557; 209/586; 209/900

[58] Field of Search ..... 209/900, 539, 557, 586

[56] References Cited

U.S. PATENT DOCUMENTS

| | | | |
|---|---|---|---|
| 2,982,407 | 5/1961 | Craig et al. | 209/900 |
| 3,069,011 | 12/1966 | Buchwald et al. | 209/900 X |
| 3,279,598 | 10/1966 | Barnard et al. | 209/539 |
| 3,938,435 | 2/1976 | Suda et al. | 209/900 |

*Primary Examiner*—Allen N. Knowles

*Attorney, Agent, or Firm*—Francis A. Varallo; Edmund M. Chung; Kevin R. Peterson

[57] ABSTRACT

A system is described for receiving mixed mail pieces, for singulating the machinable mail including flats, and for culling all of the pieces into respective discrete categories for further processing. The system is characterized by an inherent freedom from jams and consequent mail damage and features a recycle loop which provides a continuous, substantially uniform output of machinable mail.

15 Claims, 20 Drawing Figures

MAIL SINGULATION AND CULLING SYSTEM

BACKGROUND OF THE INVENTION

The culling of mixed mail pieces into discrete categories is an essential step in the processing of mail to its ultimate destination. Accordingly, the mechanization of mail culling has been an ongoing project for many years. Much of the effort has been concentrated on producing an output flow of machinable letter mail. The equipment which has been developed uses various techniques to cull out those mail pieces which, because of various dimensions such as overall size, thickness, or weight, are outside the predetermined limits of machinable letter dimensions. The latter mail pieces are identified generally as flats, parcels, rolls, etc. Unfortunately, the flats removed by present day processes are culled out at different locations for various reasons. For example, the gaging roller technique culls mail pieces which exceed the ¼-inch letter mail thickness. The material culled by this process includes slugs (mail pieces of irregular dimensions which preclude the stacking thereof one upon the other), small parcels, rolls and flats which are thicker than ¼-inch. Another widely used technique is the flats extractor which removes mail pieces which exceed a certain height. These mail pieces include flats which are generally under ¼-inch thick and letter size mail standing on end. A third technique which has been utilized is air-culling in which documents are removed from the mail stream when they exceed a predetermined weight-to-surface area ratio. The material removed by this last technique is a mixture of heavy flats, slugs, small parcels and rolls. It will be noted that in the aforementioned examples, the flats have been culled at three different locations and have been mixed with non-machinable mail pieces. The recovery of the machinable flats involves considerable time and labor which would have been eliminated had a single output of machinable flats been provided during the culling process.

In achieving the last mentioned goal, it should be noted that the variation of flat mail size and weight greatly compounds the difficulty of using existing letter size mail processing techniques. Also collection mail may contain items which are extremely difficult to handle by automated equipment. What is required to handle the variability of mail pieces is equipment of relatively simple low-velocity open construction which will be inherently free from hard jams and mail damage. The system of the present invention fills such a need.

SUMMARY OF THE INVENTION

In accordance with the present invention, the problem of singulating and culling machinable mail, including flats, is solved by utilizing multiple stations arranged in a series relationship and performing the functions of receiving, delivering, singulating, size-detecting and outputting the mail pieces. Another important consideration involves that of recirculation within the system whereby documents delivered to the receiving stations are recycled if for some reason they do not immediately proceed through the remaining above-mentioned stations.

Briefly, in operation the collection mail enters the present system and is supplied to a plurality of receiving stations. If, at a given time, the singulation station is able to accent the mail pieces, the latter are furnished thereto by way of associated delivery stations. On the other hand, if the singulation station does not call for mail, the receiving stations have the capability of depositing the mail that they receive onto a recycle conveyor, where in due course and after the culling of some non-machinable items other than certain flats, it is again supplied to the receiving stations.

In the singulator slide, which in the present system slopes downward on an incline and includes a plurality of friction rollers, the documents are separated one from the other and emerge in a stream of individual documents. At this point the mail enters the size detection station where it is measured for thickness, length and width. Based upon the measurements obtained for each piece of mail, the size-detection station activates one of a plurality of gates to divert from the mail stream certain of the mail pieces, or fails to activate any of the gates. The former action results in the diverting respectively of machinable flat mail, machinable letter size mail and undersize letter mail. Mail in each of these categories is transported directly to other locations for further processing by means of take-away conveyors associated respectively with the gates. If none of the gates is activated by the size-detection stations, it is implied that the mail piece is non-machinable. Such pieces continue past the gates and are collected in a tray at the end of the slide.

The foregoing features of the present system, as well as others, will become more fully apparent in the detailed description and operation which follows.

DESCRIPTION OF THE PREFERRED EMBODIMENT

Figure 1:
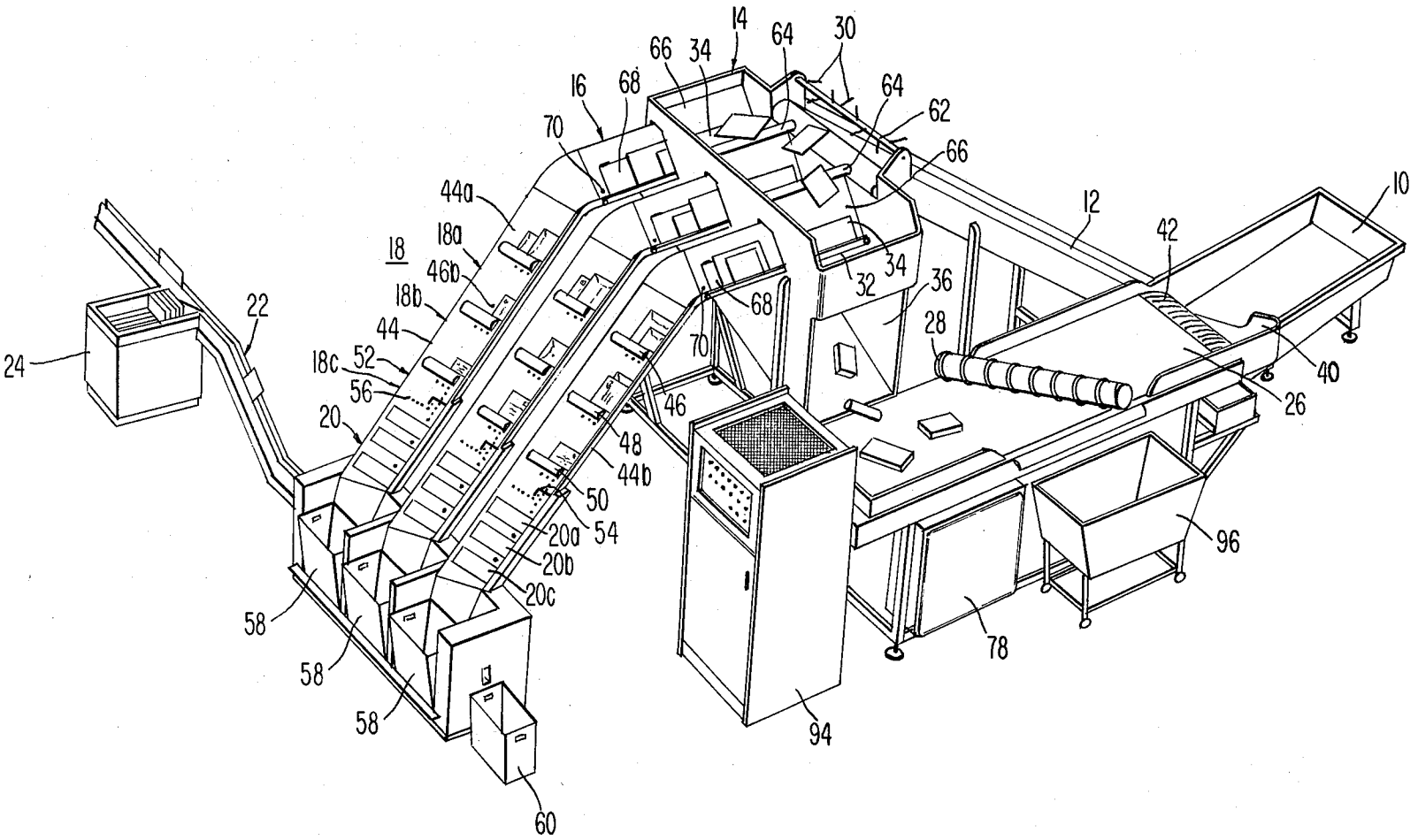
FIG. 1 is a pictorial diagram illustrating the layout of the mail singulation and culling system of the present invention.

The layout of an embodiment of the mail singulation and culling system of the invention is depicted in FIG. 1. The basic elements of the system include the vibrating hopper 10, inclined conveyor 12, receiving stations 14, delivery stations 16, singulators 18, size detection stations 52, gating area 20, take-away conveyors 22, the letter stacker 24 and the recycle conveyor 26 and gaging roller 28. It should be understood that the characteristics presented herein relating for example to specific configurations and quantities of system elements have been chosen for purposes of example, and are not to be construed as limitative of the inventive concepts taught herein.

With reference to FIG. 1, all mail, including collection mail and overthick plus oversize mail from the letter mail culler (not shown) enters the present system through the vibrating input hopper 10 which furnishes the mail to the inclined conveyor 12. The input hopper amplitude of vibration and inclined conveyor motor belt speed are preset to provide an adequate supply of mail to the receiving stations 14 to meet system throughput requirements. Rotating fingers 30 at the top of the incline aid in dispersing individual mail pieces to each of the three receiving station compartments.

At the bottom of each receiving station is a narrow horizontal conveyor belt 32 that forms a shallow shelf which catches one or more mail pieces and transports the mail to the singulator. When mail is not called for by the singulator, a vane 34 in the rear wall of the receiving station 14 is moved forward to cover the belt and effectively eliminate the shelf. Mail moving down the wall when the shelf is covered, excess mail which will not fit on the shelf and mail pieces such as slugs, etc. which because of physical shape cannot be caught by the shelf continue downward, and are received by a common bypass chute 36 underneath the three receiving stations. The bypass chute directs the "bypas" mail to the recyle conveyor 26.

The recycle conveyor carries the bypass mail underneath a gaging roller 28 which is set to remove items over ½-inch thick and deposit them in container 96. Since the bypass mail has had some letter and flat mail removed at the receiving stations 14 and is, because of the previous processing, in a relatively thin stream, the gaging roller 28 is able to efficiently cull slugs and SPR's (small parcels and rolls) from the mail flow. The recycle conveyor 26 carries the mail which is less than ½-inch thick to a gravity return chute 40 where the mail re-enters the input hopper 10. A cull grate 42 located at the end of the recycle conveyor removes "other" non-machinables such as motel keys, etc. from the mail flow.

At the receiving stations 14, mail pieces which were retained on the horizontal belt conveyors (shelves) are transported horizontally to the left through the delivery stations 16 to the singulators 18. Each of the three mail paths leaving the three station areas is identical. A description of one path follows.

As mail pieces leave the delivery station 16 they enter the first singulation station **18*a* of the singulator slide 44. The slide has a back plate 44*a* and a bottom edge guide 44*b*. The slide is designed with a compound slope in which the back plate is sloped backwards and the whole slide slopes downward at approximately a 45-degree incline. The mail moves down the slide until it reaches the first roller 46 of three high-friction rollers 46, 48 and 50, where it comes to rest. Upon automatic detection a command causes the roller 46 to rotate and advance the mail to the second roller 48. The process is repeated to advance the mail to the third roller 50**. As will be described in detail later, each roller is capable of separating a single document from two or more documents such that the mail pieces are singulated by the time they leave the third roller.

Documents leaving the third roller 50 enter the size detection station 52 where they are measured for thickness by a sensor 54 and pass through a photocell array 56 for length and width measurement. Depending upon the size measurements, none or one of three gates **20*a*, 20*b* or 20*c* immediately below the size detection station is activated. The first gate 20*a* opens to divert machinable flat mail, the second gate 20*b* diverts machinable letter size mail, and the third gate 20*c* diverts undersize letter mail. Mail from the three gates is collected on three take-away conveyors 22 which also serve the other two mail paths. Non-machinable mail pieces continue past the gates 20*a*, 20*b* and 20*c* and are collected in a tray 58 at the end of the slide 44**.

The machinable flats resting on a take-away conveyor are now transported directly to the facing and cancelling equipment. The machinable letter size mail is transported by a take-away conveyor to the stacker module 24 where it is accumulated for tray loading. The undersize letter mail is transported by a take-away conveyor to a collection tray 60.

SYSTEM ELEMENTS

The following is a detailed description of the elements which comprise the present system.

Vibrating Hopper

A vibrating hopper 10 similar to that presently in use by the U.S. Postal Service in its model 500B Edger Feeder System, may be employed in the present system. The control of the hopper is somewhat different, however. In the Edger Feeder, the vibrating motion is intermittent, as determined by sensing fingers located on the inclined conveyor. The latter device is positioned adjacent the hopper for receiving the mail pieces therefrom. In the present system, the vibrator remains "on" all of the time. The reason for this is that while sensing finger control of the thickness of the mail stream on the conveyor is satisfactory for letter mail, the flats and SPR's handled in the present system may jam against the fingers and cause false indications of average mail stream thickness. Instead of turning the vibrator on and off, the amplitude of vibration is preset to deliver a surplus of mail to the inclined conveyor 12 to meet throughput requirements, and the excess mail is automatically recirculated in the manner described hereinafter in connection with the receiving stations 14 and recycle conveyor 26.

Inclined Conveyor

An inclined conveyor 12 similar to that used in the aforementioned Model 500B Edger Feeder is utilized. The conveyor belt speed is preset to deliver a surplus of mail to the receiving stations to meet system throughput requirements. As noted earlier, the excess mail is recirculated.

Figure 2:
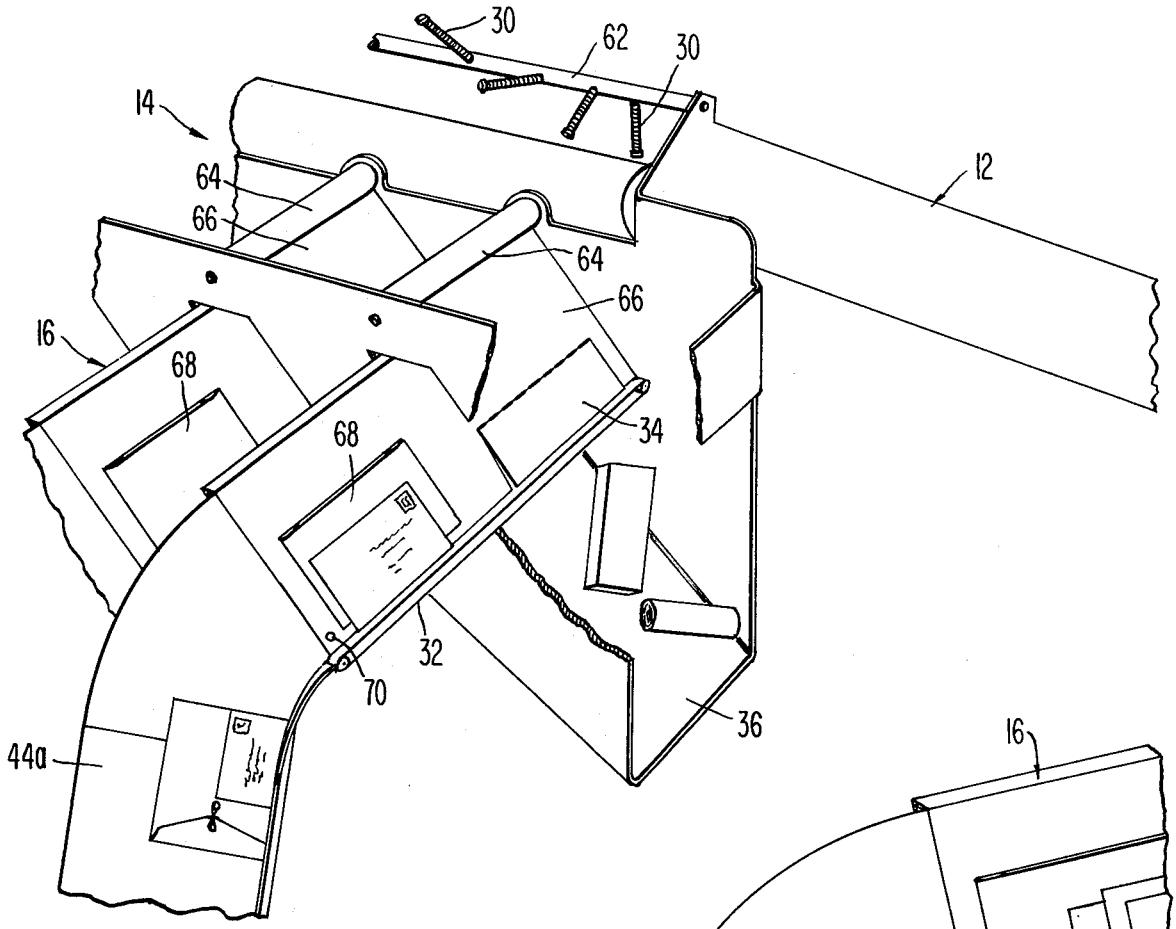
FIG. 2 depicts two sets of the mail receiving and delivery stations utilized in the system of FIG. 1.

The inclined conveyor used in the Edger Feeder employs a set of wheels at the top of the conveyor to aid in separating the mail pieces. As in the case of sensing fingers, this technique is not effective with collection mail. As seen in FIGS. 1 and 2, the present system makes use of a device utilized by the U.S. Postal Service in the Model M-36 Facer-Canceller. This device comprises a rotating shaft 62 having a plurality of spring fingers 30 mounted spirally about the shaft. As the shaft rotates, the spring fingers sequentially engage individual mail pieces to produce separation.

Receiving Stations

Three receiving stations 14 are illustrated in FIG. 1. Mail from the inclined conveyor enters the respective compartments of the stations. With additional reference to FIG. 2, an aid to dividing the mail flow and preventing mail pieces from hanging on the partitions between stations is provided in the form of two rotating rollers 64 driven by motor means (not illustrated). The rotation of these rollers tends to divert mail from the center compartment to the outer compartments.

Each of the three receiving stations 14 has a backplate 66 inclined approximately between 45 and 60 degrees from the horizontal. Located at the bottom of the backplate is a horizontal conveyor belt 32 positioned approximately 90 degrees with the backplate so as to form a shelf approximately one-fourth to one-half inches wide. The backplate 66 contains a vane like member 34, hinged on its upper extremity so as to permit its lower opposite extremity to pivot therearound. This pivotable vane is attached to a moveable arm (not shown) such that motion in a forward direction causes the lower extremity of the vane to cover the horizontal belt.

Under this latter condition, the mail pieces leaving the inclined conveyor will drop, contact the backplate, and slide down the plate. On the other hand, when mail is required by the singulator 18, the vane 34 is retracted, the conveyor belt 32 located at the bottom of the backplate is uncovered and the shelf formed thereby is able to catch mail pieces. The number of pieces captured is determined by the thickness of the mail and the width of the shelf. When the shelf is covered by one or more mail pieces, any excess mail continues down past the shelf to the bypass chute 36, to be recirculated. The captured mail pieces are transported on their edges into the delivery stations where their motion is assisted by flat belts 68. Photocell sensing means 70 located in the latter stations are covered by the mail pieces, causing the vane in the receiving station to be moved forward to again cover the conveyor belt and the horizontal conveyor to stop, provided that the presingulation photocells 72 (FIG. 3) upstream of the first singulation stage, or station 18*a*, indicates the presence of mail therein. If station 18*a* is unoccupied, the conveyor 32 will continue to move until both the delivery station 16 and the first singulation station 18*a* contain mail. It will be observed that when the vane 34 covers the conveyor 32, the receiving station is self-purging, that is, the mail pieces cannot back up above the station, and instead continue down to the bypass chute 36.

Most thick objects, such as small parcels, rolls and slugs, will not be captured by the shelf because of their size, shape, and location of center of gravity. This material, along with the other bypass mail, is collected by the bypass chute 36 and is deposited on the recycle conveyor 26.

Delivery Station

Figure 3:
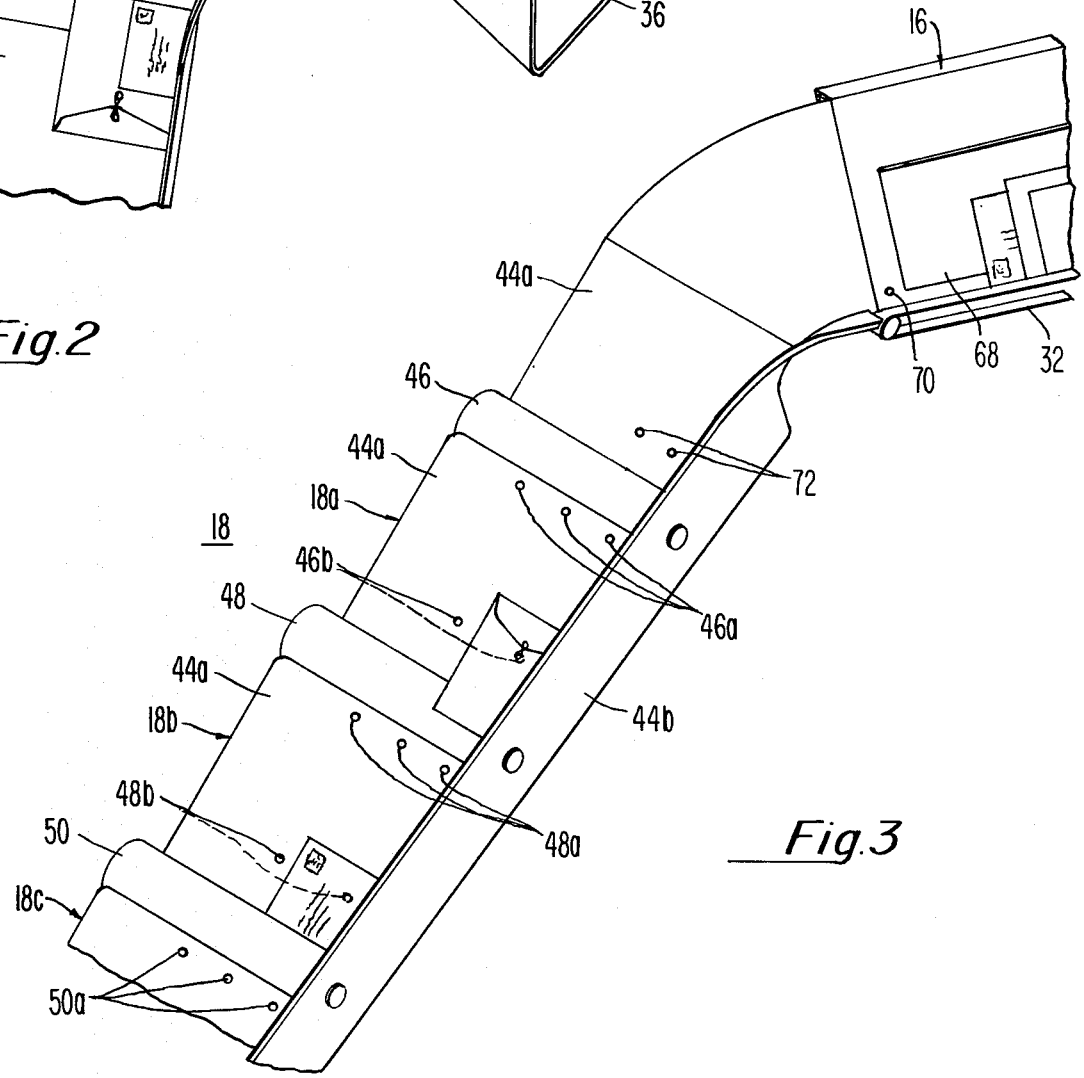
FIG. 3 is a pictorial view of a singulator slide including three singulation stations.

The delivery station 16 also illustrated in FIG. 2, receives the mail from the receiving station 14 and supplies to mail to the first singulation station 18*a* (FIG. 3). Photocells 72 sense when the station 18*a* is empty and signal for more mail. The horizontal belt 32 which spans the receiving station and the delivery station is activated and transports the mail in the delivery station to the first singulation station. As the mail leaves the delivery station a photocell 70 in the delivery station is uncovered and causes the vane 34 in the receiving station to retract. Mail pieces are then captured by the shelf and are transported to the left by the horizontal conveyor 32. When the delivery station photocell 70 is covered again, the receiving station vane is restored to cover the shelf.

Singulator

Each of the three singulators depicted in FIG. 1 is comprised of three singulation stages, or stations 18*a*, 18*b* and 18*c*, and these are illustrated in greater detail in FIG. 3. The latter singulation stations include respective rollers 46, 48 and 50 covered with a high coefficient of friction compound. Each roller is mounted on sheet metal guides. The back 44*a* and edge guides 44*b* of the singulator slide 44 form a 90-degree "V" trough which is sloped downwards at approximately 45 degrees. Thus, the singulator slide with its compound slope maximizes the employment of gravitational forces in guiding documents down the incline in an orderly and uniform manner with one common edge registration. Leading edge registration is also produced as the documents impact and momentarily park at each singulating roller in preparation for size detection. Singulation photocell assemblies 46*a*, 46*b*; 48*a*, 48*b*; and 50*a* are associated with the respective rollers 46, 48 and 50. It should be noted that for the third singulation station 18*c*, the function of the second of the pair of photocell assemblies is performed by strobe photocell "S" of the succeeding size detection station 48, and a "50*b*" assembly is not required. The rollers are independently driven by stepping motors in order that they can be rapidly started and stopped.

Mail flow through the singulation stations begins when the horizontal conveyor 32 in the delivery station 16 advances the mail to the upper singulation station 18*a*. As the mail leaves the conveyor it curves around the transition between the two paths and slides down to the first roller 46. A sequence of singulation by a roller such as 46, is illustrated in FIGS. 4A, 4B and 4C.

Figure 4A:
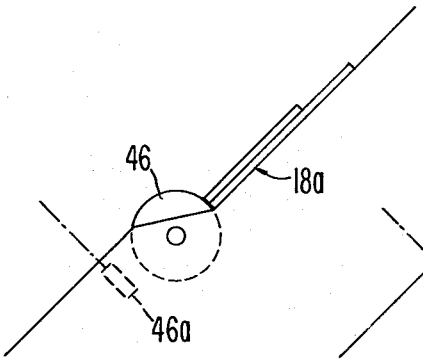
FIGS. 4A, 4B and 4C indicate in schematic form, the sequence of events involved in the separation of the mail pieces by the friction roller in one of the stations shown in FIG. 3.
Figure 4B:
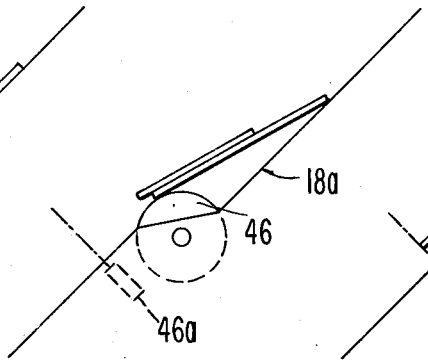
Figure 4C:
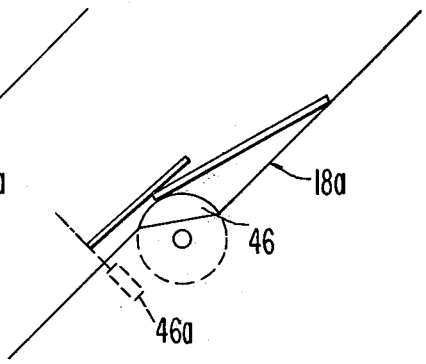

In FIG. 4A two pieces of mail are shown resting on the roller 46. A signal calling for mail derived from photocells 46*b* upstream of roller 48 causes the roller 46 to rotate approximately 90 degrees and then stop. The two mail pieces advance to the position illustrated in FIG. 4B. During the roller dwell period the top mail piece continues to slide while the bottom piece is restrained by the roller. As the top mail piece continues to slide down to roller 48 of the next singulation stage 18*b*, the leading edge interrupts the photocell 46*a* which generates a signal to prevent the roller 46 from restarting its rotation. The bottom mail piece remains in this position until the next feed signal from photocells 46*b* is received. If the photocell 46*a* is interrupted before the roller 46 has moved 90 degrees, the rotation will be stopped at that time.

If there had been only a single mail piece on the roller in the previous example, then at the end of the roller dwell period the photocell 46a would not have been interrupted and the roller 46 would have been restarted to advance the single mail piece to the next singulation station 18b.

If there had been three mail pieces on the roller, the top two mail pieces might have advanced to the second singulation station 18b and would be singulated there. The third singulation station 18c (FIG. 3) is an additional stage to reduce to a minimum the number of double documents which might enter the size detection station 52.

Size Detection Station

Figure 5:
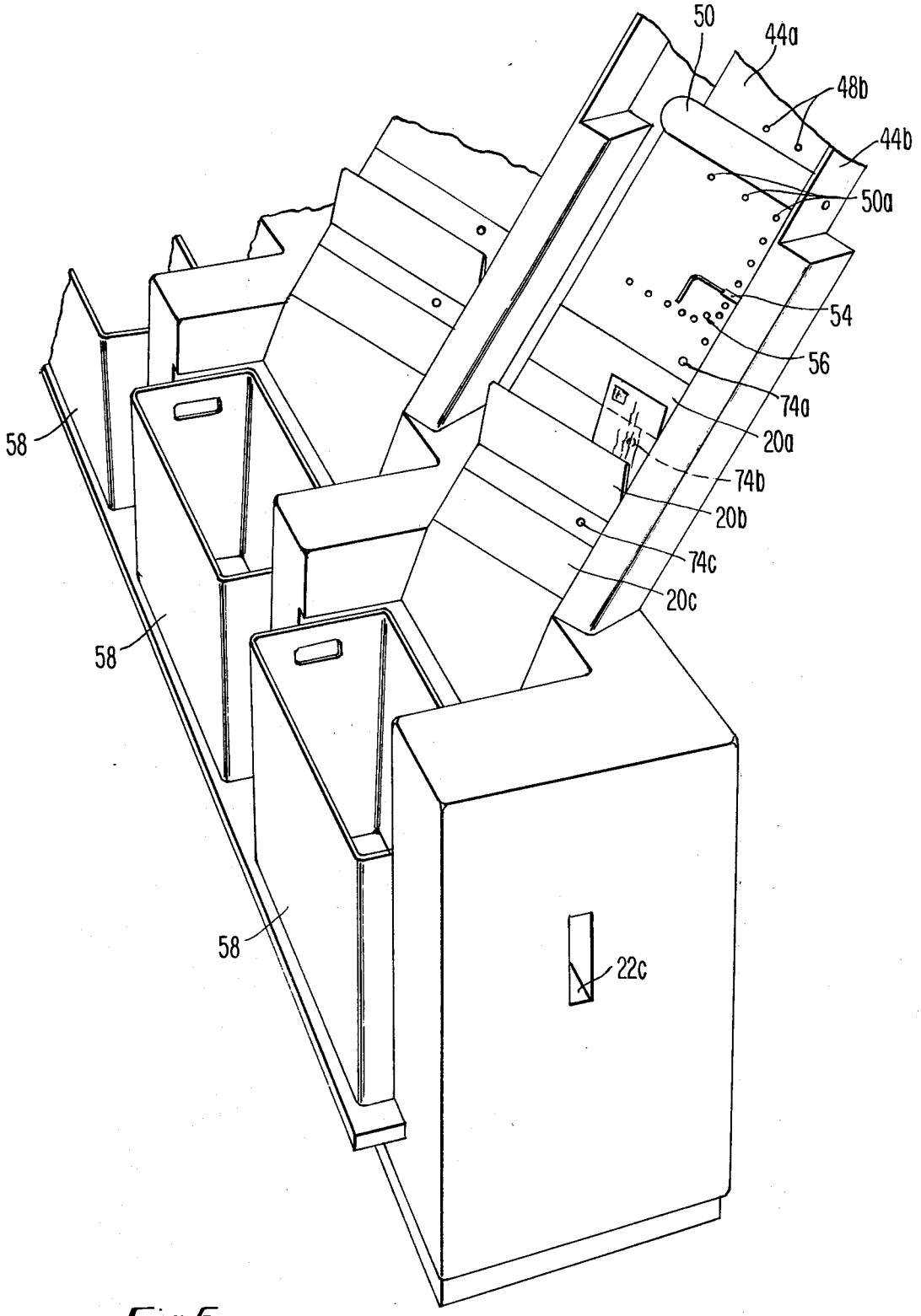
FIG. 5 illustrates the size measurement station and gating means used in the system of FIG. 1.
Figure 13A:
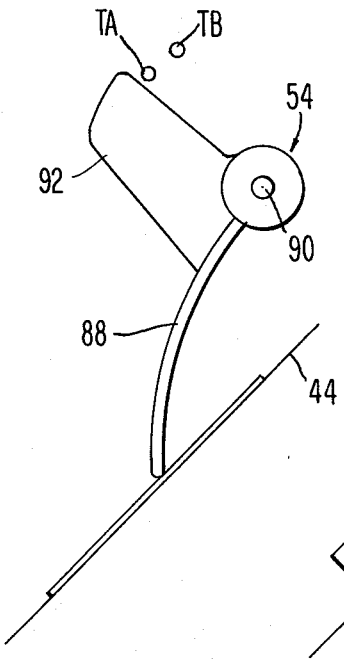
FIGS. 13A, 13B and 13C depict the electromechanical details and operation of the thickness detector illustrated generally in FIG. 5 and referenced in FIG. 11.
Figure 13B:
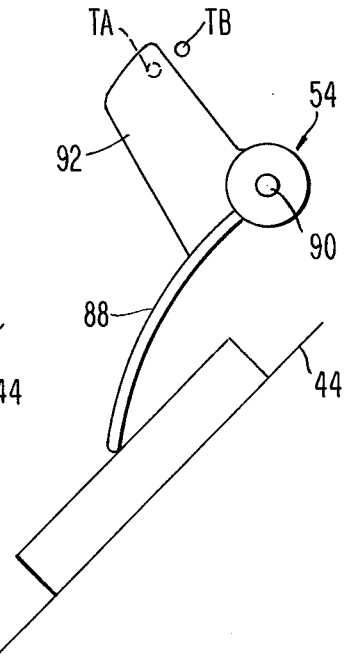
Figure 13C:
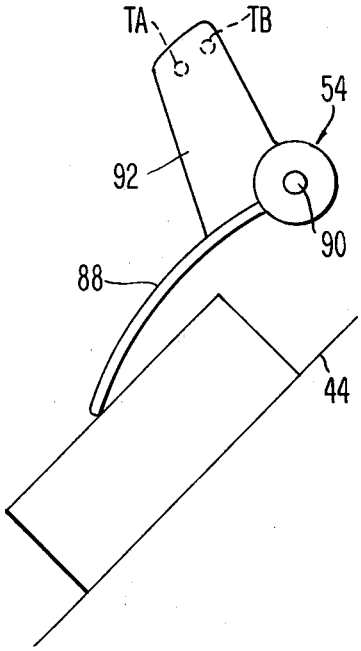

The last singulation station 18c transports the mail piece to the size detection station. As shown in FIG. 5 the station includes an array of photocells 56 which measure the length and width of the mail piece. The skew of the document is also checked as will be described in a later section. The thickness of the mail piece is gaged by the sensor 54 located in the station. As the document passes through the size detection station 52 the gaging arm of sensor 54 is pivoted up. As seen in FIGS. 13A, 13B and 13C, two photocells "TA" and "TB" located in the pivot assembly provide signals if the thickness exceeds one-fourth and one-half inch.

Gating

FIG. 5 also illustrates the gating arrangement. There are three gates that segregate the mail into four categories. The first gate 20a is for machinable flats, the second 20b for machinable letters, the third 20c for undersize letters. A fourth category (all three gates shut) is reserved for non-machinable mail. As described hereinafter relative to FIG. 14, the gates are solenoid operated and photocells 74a, 74b and 74c preceding the respective gates provide gate timing signals to open the gate prior to the leading edge of the document and close the gate after the passage of the trailing edge. The gates in this system are normally kept closed and allow any non-machinable document to pass directly to the end of the slide 44 and into the trays 58.

Figure 6:
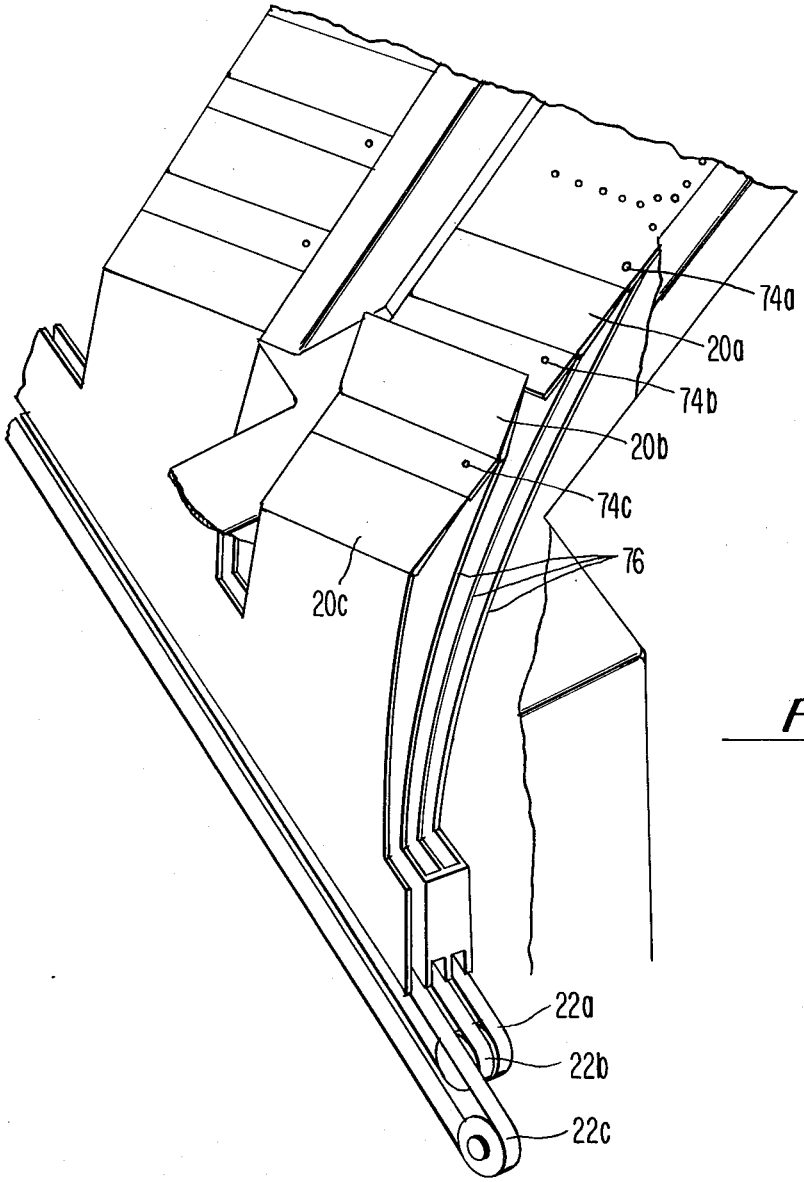
FIG. 6 depicts the takeaway conveyor assembly.

Sheet metal guides 76 as seen in FIG. 6 below the gates direct the diverted mail pieces down to the takeaway conveyors 22 where the pieces land on their edges.

Takeaway Conveyor

The takeaway conveyors 22 are illustrated in FIG. 6 The mail is transported on edge between side guides by individual flat conveyor belts 22a. 22b and 22c in the bottom of each channel. For illustrative purposes the undersize letter conveyor 22c is shown bringing the letters forward to be dropped into the tray 60 (FIG. 1). It can also transport the letters in the opposite direction just as easily. Provision is made where the conveyors collect mail from the gate areas to deflect mail pieces already on the belt from the previous transports such that they will not interfere with entering mail pieces.

The machinable flats conveyor belt 22a interfaces with the edge conveyor which transports the flats to the facer-canceller area and the letter mail conveyor belt 22b transports the letters to a stacker 24 (FIG. 1).

Letter Stacker

As seen in FIG. 1, the letter mail stacker 24 is required to receive letters, on edge and randomly positioned, and to form the letters into a stack sufficient for manual transfer to mail trays. There are many stackers presently in use by the Postal Service which perform this task. The letter mail conveyor 22b can also interface with an edge conveyor to remove the letters from the area if required and directly connect to downstream processing equipment.

Recycle Conveyor and Gaging Roller

With continued reference to FIG. 1, the bypass mail is returned to the input hopper 10 by the recycle conveyor 26. The mail which the recycle conveyor receives is in a relatively thin uniform stream and has had a portion of the machinable mail pieces removed from it. It is therefore, in a preferred condition for passing under a gaging roller 28 to remove SPR's and slugs. The gaging roller, set at ½ inch, will remove all mail pieces exceeding this dimension in the conventional manner.

CONTROL SUBSYSTEM

The control subsystem includes all electronic assemblies and components required to monitor and make decisions concerning mail flow and on/off sequencing of transport and gate devices. The monitoring and decision-making devices regulate the flow of input mail, control singulation, sense size, and distribute mail into specified classes. The control subsystem also responds to several detectable system or component faults, lights appropriate indicators, and interrupts power to drive-motors where required. The components of the control subsystem include those concerned with AC power interruption and monitoring controls, and the solid-state relays which are used to start and stop transport-mechanism motors. These components are located in the AC load-center cabinet 78 depicted in FIG. 1

The logic cabinet 94, also shown in the last mentioned Figure, contains DC power supplies and all logic circuits required to monitor and control mail flow as determined by input signals supplied thereto by the distributed monitor/control subassemblies.

The distributed subassemblies, located contiguous to the mechanical assemblies of the present system include light modules located opposite the aforementioned photodetectors, photodedector modules and associated amplifier modules, solenoid-driver subassemblies and associated gate solenoids, and motors to drive the rollers and conveyor belts.

Electronic Control

Figure 7:
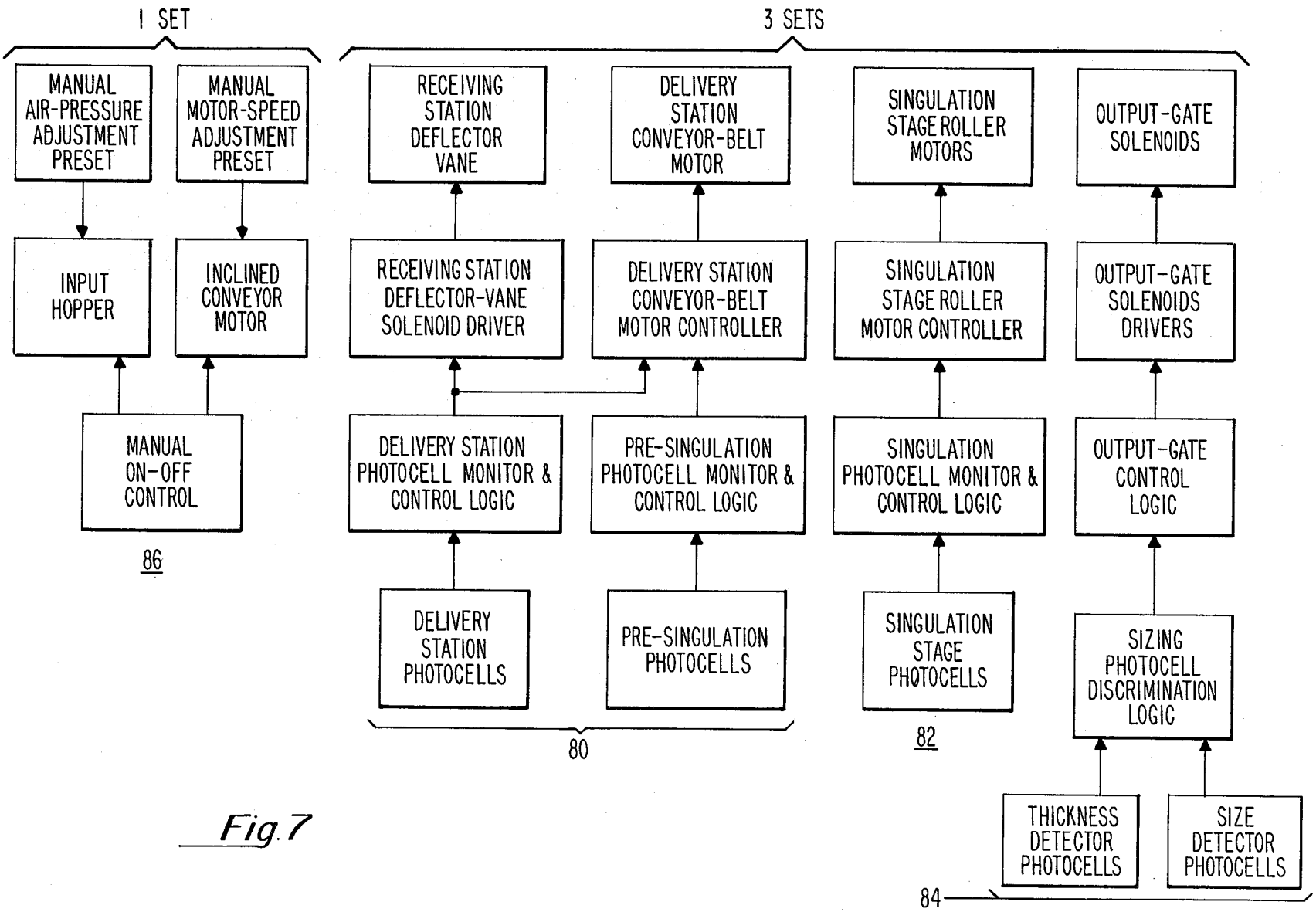
FIG. 7 is a block diagram of the control subsystem used in the system of the present invention.

FIG. 7 is a block diagram of the control subsystem illustrating the various categories of components and logic used to regulate the flow of input mail, singulate the mail, determine its size (including thickness), and control its routing to a conveyor or directly to a tray. As described hereinbefore, photocell monitors placed opposite light modules signal the arrival or departure of mail at the delivery station and at each singulation station, and provide size information concerning the singulated mail as it passes through the size-detector station prior to its being directed to a final destination.

There are three identical sets of photocells and logic associated with the three parallel mail paths shown in FIG. 1. Reference to FIG. 7 indicates that each path is divided into three areas that contain photocells and associated logic. The first area 80 is the receiving and delivery station, the second area 82 comprises the three singulation stations, and the third area 84 the size detection station. Included with this logic is control for automatic shutdown of all upstream equipment in the event abnormal interruption of flow should occur, and automatic shutdown of the system if continued operation may be harmful to personnel, mail, or equipment, or if it may degrade system performance.

Transport Control

Transport control is required to regulate the flow and edge the mail prior to singulation. The control subsystem must therefore control the input hopper, the inclined conveyor, receiving station, and the delivery-station conveyor belts which move mail to the first singulation roller of each mail path. As seen in FIG. 7, the system includes controls for area 86 involved in the adjustment of the amplitude of the hopper vibration and the inclined conveyor motor speed in order that they may operate continuously. The receiving station deflector vanes and delivery station conveyor belts are controlled so as to provide mail on demand of their downstream singulation stations.

Figure 8:
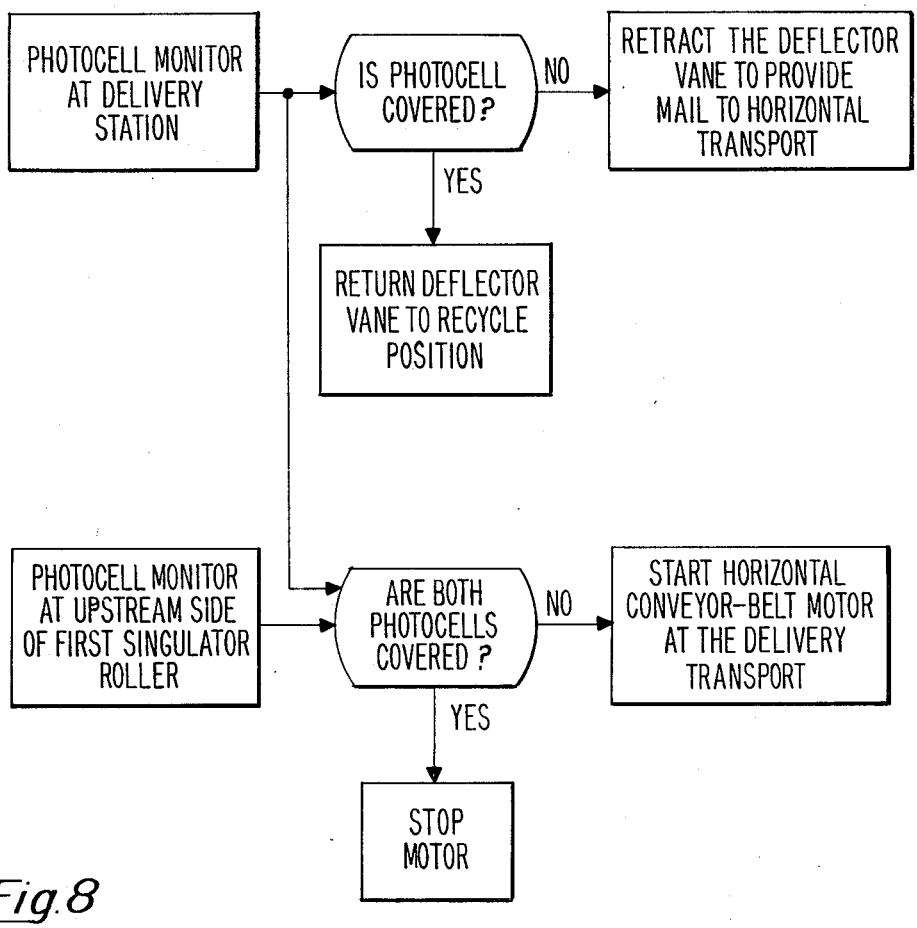
FIG. 8 is a flow diagram illustrating the transport control function associated with the receipt of mail at the delivery station and its furnishing to the first singulation station.

FIG. 8 is a flow diagram of the transport control function. Mail entering any of the three compartments of the receiving station 14 from the input conveyor 12 either contacts the horizontal belt conveyor 32 in that compartment, or slides directly to the bypass chute 36, depending on the position of the deflector vane 34. The vane position is controlled by a photocell 70 in the downstream delivery station. 16. As long as there is a mail piece in the delivery station covering the photocell, the deflector vane will remain in position to recycle mail in the receiving station. When the delivery station requires mail, the photocell 70 will be uncovered and the deflector vane solenoid energized to retract the vane and allow mail to contact the horizontal conveyor belt and refill the delivery station.

The delivery station in turn is controlled by the photocell monitor 72 located just upstream of the first singulation station 18*a*. This photocell monitor senses if this singulation stage has mail in it. If the photocell 72 is covered indicating mail in the station, the horizontal conveyor belt 32 in the delivery station remains at rest provided that the photocell monitor 70 at the delivery station is also covered. When either or both the singulation and delivery stations are empty, the respective photocells 72 and 70 are uncovered and the horizontal conveyor belt motor is energized to permit conveyor 32 to deliver mail to the latter stations.

Typical Singulation Logic

Figure 9:
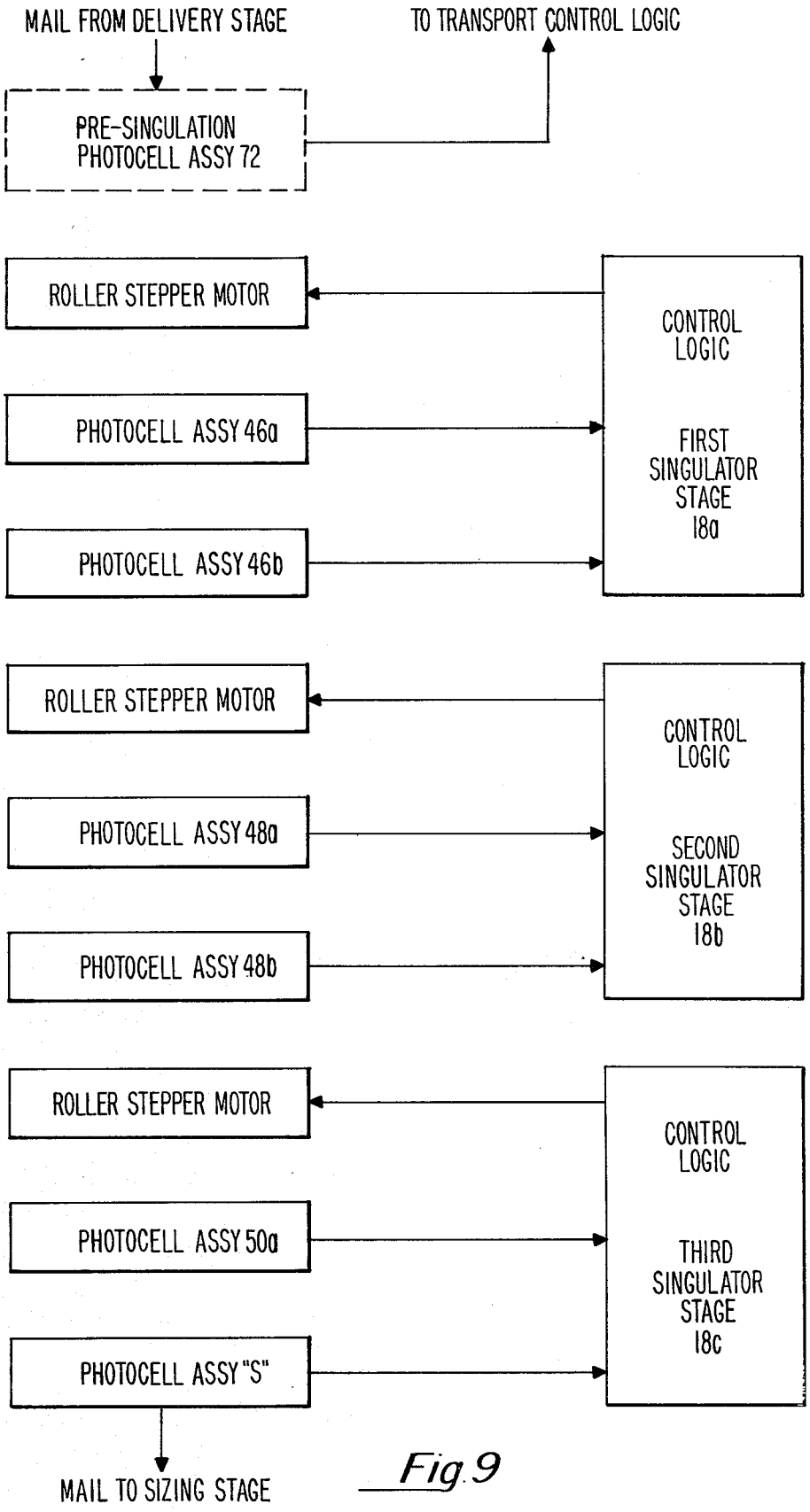
FIG. 9 is a block diagram indicating the electronic subassemblies and mail flow associated with complete singulation in one mail path.
Figure 10:
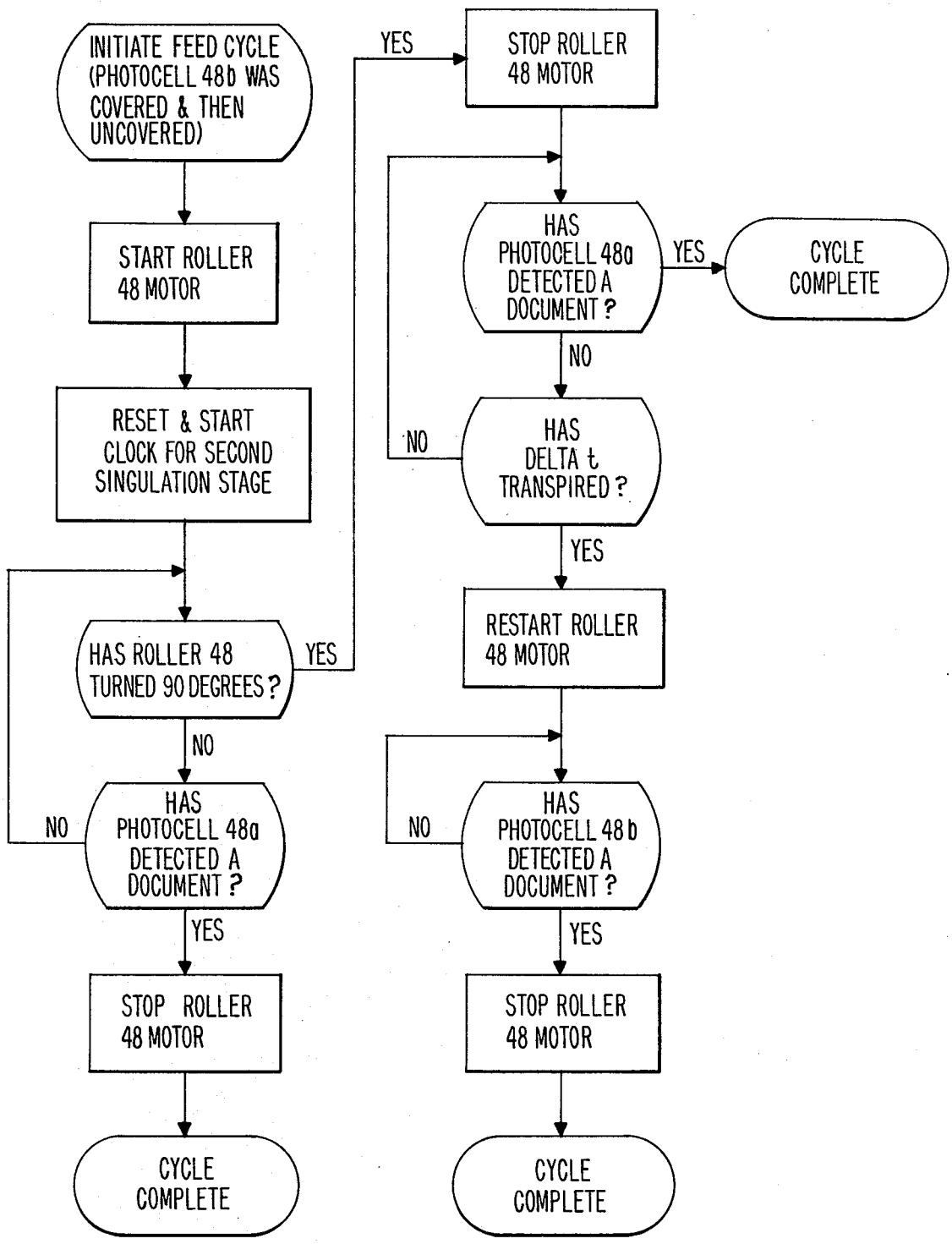
FIG. 10 is a flow diagram indicating the control sequences associated with one of the singulation stations.

FIG. 9 is a block diagram indicating the electronics subassemblies and mail-flow associated with complete singulation in one mail path. FIG. 10 indicates the control sequences associated with the second singulator stage which is typical of all three stages in all three mail paths.

As shown in FIG. 3 photocell assembly 48*b* is used to detect the need for mail from roller 48. Photocell assembly 48*a* is used in discriminating between single and multiple pieces of mail above roller 48. When photocell assembly 48*b* indicates no mail is present above roller 50, a signal is provided to a solid-state relay in the load center 78 (FIG. 1) which provides power to a stepper motor which drives roller 48. The motor will start to turn and continue to turn until the roller has rotated 90 degrees or mail has been detected by photocell assembly 48*a*. If mail has not been detected by photocell assembly 48*a* by the time the roller has turned 90 degrees, the roller will stop and pause for a fraction of a second (delta t).

Delta t allows for the time it takes the top pieces of mail (doubles in the previous station) to slip by the bottom piece which is contacting the roller 48, and fall the distance from the roller to photocells 48*a*. If no doubles were present after delta t expired, roller 48 would restart and run until the mail piece blocks photocell 48*b*.

Timing is controlled by the outputs of a digital integrated circuit "clock-counter" which is reset at the end of the last cycle and starts to run when photocell assembly 48*b* indicates that the trailing edge of mail has just been detected. The clock provides distinct outputs to indicate the end of two periods. One is the time elapsed for the stepper motor to turn its roller 48 through 90 degrees and the other at the end of 90 degrees plus delta t. If photocell assembly 48*a* has not been covered by 90 degrees plus delta t, a signal is provided to the stepper motor relay for roller 48 to start turning again. This last relay will be de-energized when photocell assembly 48*b* indicates that mail has arrived at roller 50, thereby ending the cycle. Thereafter, the trailing edge of mail passing photocell assembly 48*b* (mail leaving roller 50) will again initiate logical activity which will result in a signal to start the motor driving roller 48.

All three signulator stages in each mail path operate in an identical manner. The circuitry therefore consists of nine modular and interchangeable blocks.

Size Detection and Output Gating

Figure 11:
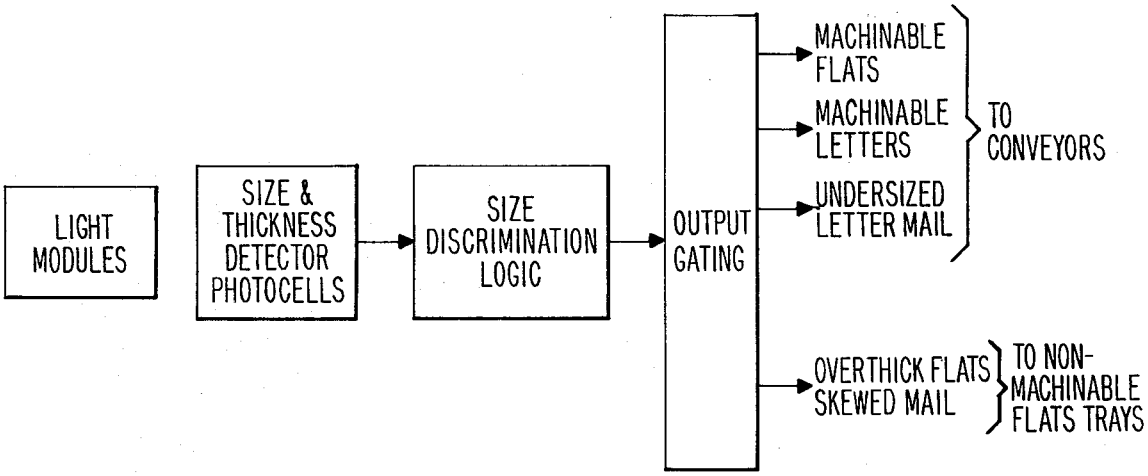
FIG. 11 illustrates in block diagram form the function of the mail size and thickness detection stage in distributing the mail pieces to four respective locations.
Figure 12:
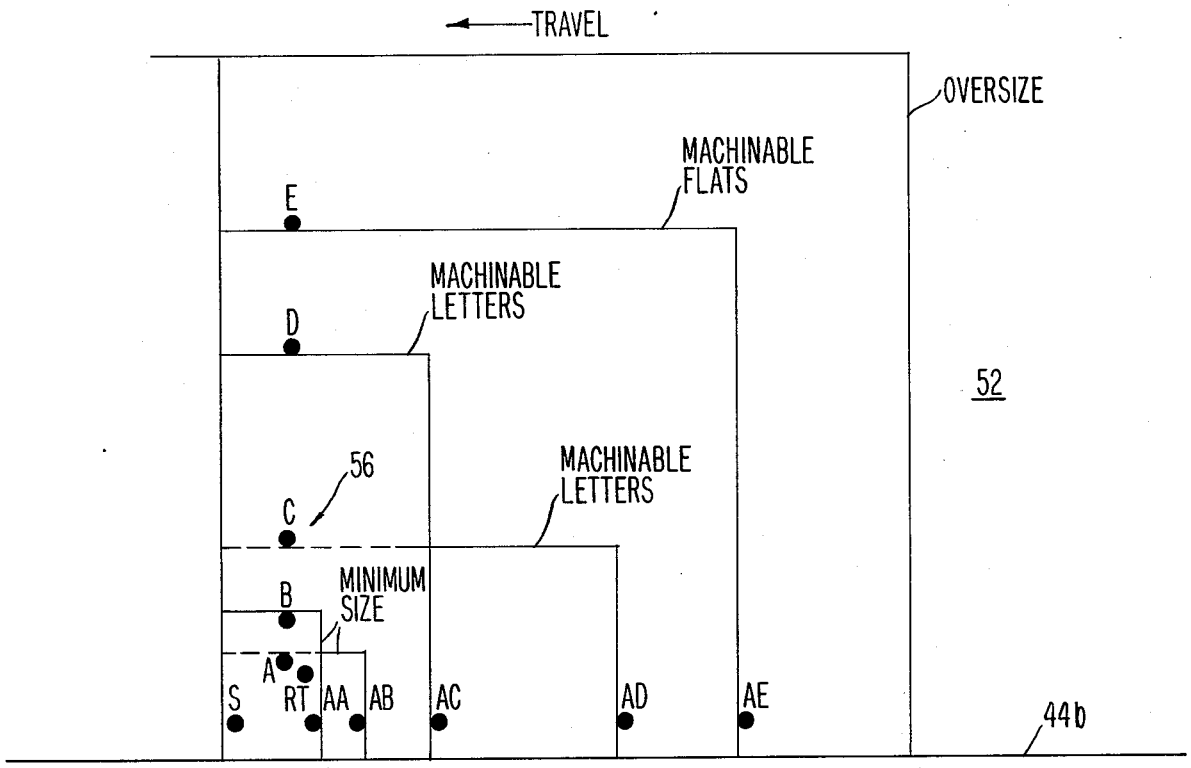
FIG. 12 shows the photocell matrix arrangement which provides the information needed to determine the sizes of the mail pieces as they traverse the size detection station.

The last singulation stage 18*c* is followed by a size-detection stage 52 which controls output gating. It includes several photocells 56, as seen in FIG. 12, which are used to measure the size of a single piece of mail and detect that it is in position for size-measurement. A thickness-sensor 54 and adjunct photocells, "TA" and "TB" as seen in FIGS. 13A, 13B and 13C, are also included within this stage. As described in FIG. 11 output gating to four locations is determined by size and thickness.

FIG. 12 shows the photocell arrangement which provides information needed to determine size. The photocell array is strobed when the mail covers the "S" (Strobe) photocell. Two banks of photocells independently determine size in the direction parallel to travel or perpendicular to the direction of travel. For example, if both photocells "B" and "AB" are uncovered or if either one or both of photocells "A" and "AA" are not covered when the strobe photocell "S" goes from light to dark, the mail is undersize, and is gated to the undersize conveyor 22*c*.

Once the "minimum-size" photocells are covered, additional photocells are required only to determine maximum dimensions for machinable letters, and machinable flats. For example, if, when the strobe photocell is first covered, photocells "A" through "D" and "AA" through "AC" are all covered and photocells "E", "AD" and "AE" are not covered, the mail will be sized as machinable-flats. An example of photocell coverage for machinable letter mail would be photocells "A", "B", and "AA" covered and photocells "C" through "E" and "AB" through "AE" uncovered. A complete description of the size detection logic is undertaken hereinafter with reference to FIG. 14.

Because of the compound slope of slide 44 and the parking of the documents at the singulation rollers, the skewing of the mail pieces will be minimal by the time they reach the size-detection stage and does not affect the sizing determination. In order to preclude skewing difficulties however, the present system incorporates electronic circuits to detect excessive skew, and provides for the rejection of such mail. As the document moves through the sizing stage 52, it may be skewed in either of two directions: in one case, the leading edge of the document will not touch the bottom edge guide; in the other, the trailing edge of the document will be away from the edge guide. In either case, skew below a nominal amount will be acceptable as determined by the sequence in which two photocells ("RT" and "A") are covered as the mail moves through the stage. As long as "RT" is covered before "A", the size determination will be considered valid. If "A" is covered before "RT", it is to be assumed that the skew is too great and the mail will be rejected and deposited in the non-machinable trays 58.

With reference to FIGS. 13A, 13B and 13C, thickness is detected in this stage by sensor 54 including an arm 88 which is rotated about a pivot shaft 90 when mail is travelling through the area. The sensor assembly includes in addition to arm 88, a vane 92 attached thereto, a pair of photocells "TA" and "TB" and and light means (not shown but disposed within the sensor assembly) for illuminating the latter. The vane is situated with respect to the photocells and light means such that rotation of the arm causes the vane to be interposed between the light means and one or both of the photocells. Thus, in FIG. 3A, if the document being sensed is ¼-inch or less in thickness, the rotation of the arm is insufficient to cause the vane to block either of the photocells "TA" or "TB". The document in FIG. 3A may be an oversize flat, a machinable flat, a machinable letter or an undersize letter. In FIG. 3B, the document is assumed to be an oversize flat or a machinable flat having a thickness of more than ¼-inch but less than ½-inch. In this case, photocell "TA" is darkened, while "TB" remains light. Finally, in FIG. 3C, an oversize document having a thickness greater than ½-inch, causes vane 92 to block both photocells "TA" and "TB". As will be considered in detail hereinafter in connection with the gating logic of FIG. 14, the photocells provide electrical signals indicative of the respective documents being sensed. Overthick documents will be caused to bypass the gates and to be deposited in the non-machinable trays 58.

The electronic circuits and devices employed for size discrimination may be found at three locations, namely, at the size-detection station 52, the logic cabinet 78, and the three output gates **20*a*, 20*b* and 20*c***. The size detection station contains light modules, photocells to provide size detection and thickness discrimination and photocell amplifiers. Various logic circuits including that for size discrimination, skew test, and output gate control are to be found in the control logic cabinet. Finally, items located at the three output gates include light modules, photocells upstream of each gate, photocell amplifiers, gate solenoids, and solenoid drivers.

Figure 14A:
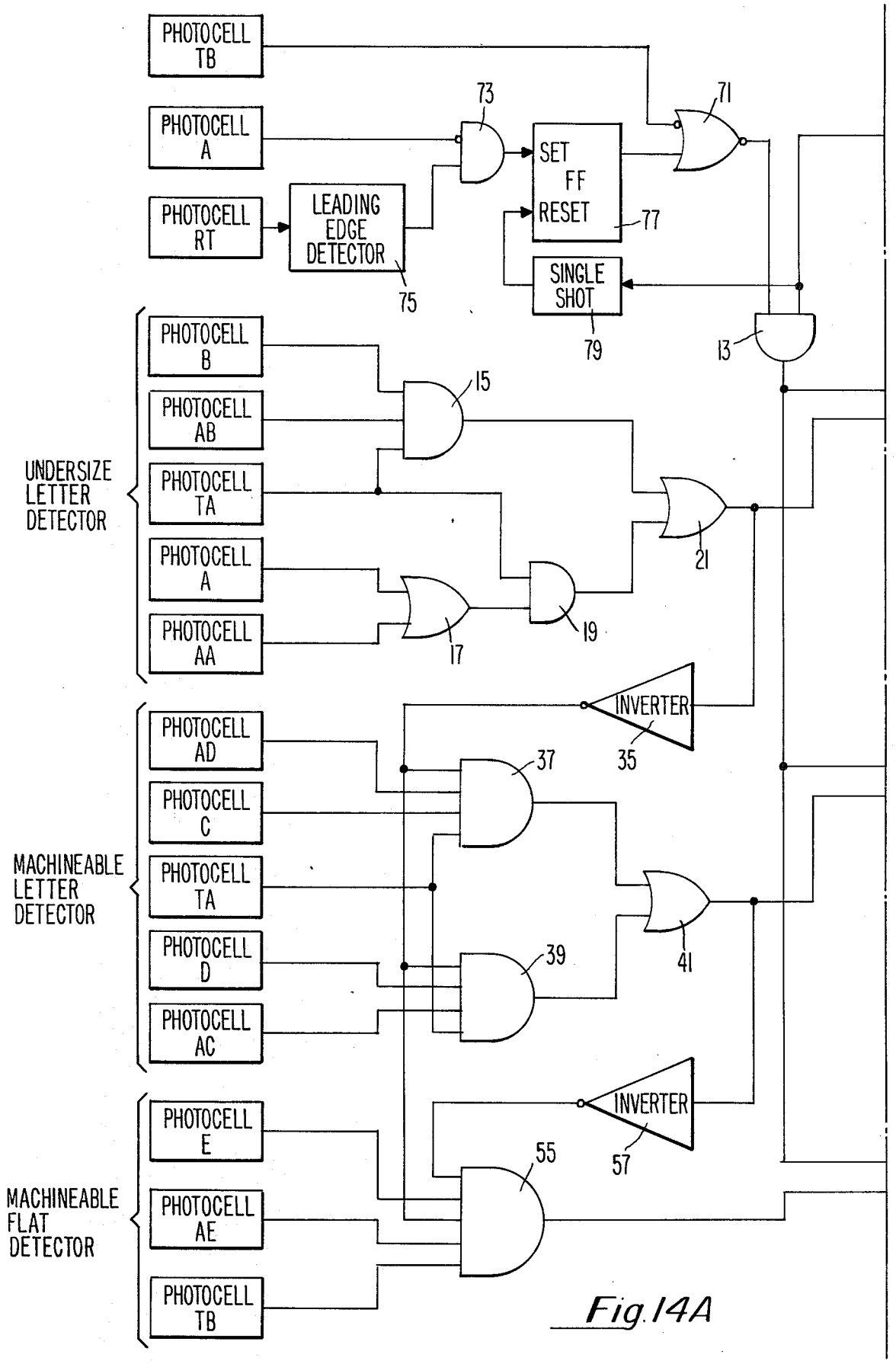
FIG. 14 comprises FIG. 14A and FIG. 14B which together are a logic diagram for size discrimination in implementing the output gating of mail into the categories indicated in FIG. 11.
Figures 14, 14B:
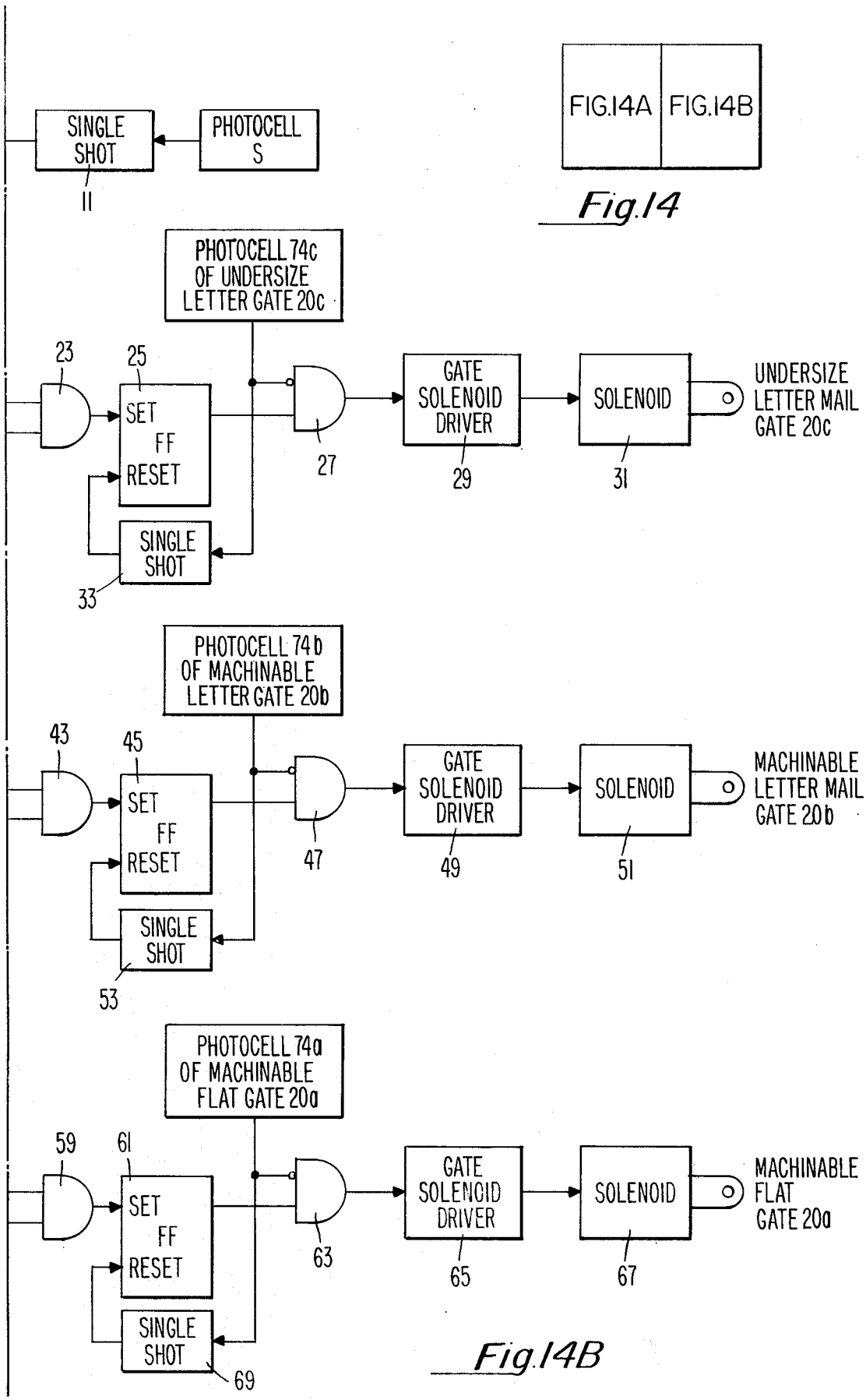

With reference to the size-detection logic of FIG. 14, three sets of logic gates are employed respectively for undersize letters, machinable letters, and machinable flats.

Considering each of the latter documents in turn, the photocell conditions which must be present to detect each are defined in FIG. 14. With additional reference to the photocell matrix of FIG. 12, it will be assumed that a piece of mail has arrived at the strobe photocell "S". In going from a light state to dark, photocell "S" applies a signal to single shot 11, which produces an output therefrom which is applied to one of the inputs of AND gate 13.

If the document is an undersized letter, reference to FIG. 12 will show that either of two conditions will be present. In the first of these conditions, photocells "B" and "AB" of the matrix and "TA" of the thickness sensor will all be light. In the second condition, either photocell "A" or "AA", or both photocells, will be light.

In the first condition, signals from photocells "B", "AB" and "TA" (all being light) applied to AND gate 15 produce an output therefrom indicative of the presence of an undersize letter. Similarly, signals from photocells "A" and "AA" are OR-ed together in gate 17 such that if either one of these photocells, or both are light, an input signal is applied to one input of AND gate 19. Photocell "TA" in the thickness sensor 54 applies a signal to the other input of AND gate 19, and if photocells "TA" is light indicating that the document thickness is less than ¼-inch, the latter gate produces an output signal also indicative of the presence of an undersize letter in the size detection station. The outputs from AND gates 15 and 19 are applied to "OR" gate 21, the output of which is used in controlling the operation of the appropriate gate.

It will be assumed at this point that the document being sensed is neither overthick nor skewed. A consideration of the logic associated with these conditions and its blocking effect on the gate operation will be made hereinafter. Accordingly, the output of "OR" gate 21 is applied to one of a pair of inputs to "AND" gate 23. In accordance with the assumptions made above as to skew and thickness, "AND" gate 13 applies an enabling signal to the other input of "AND" gate 23. The output of the last mentioned gate sets an output gate controller flip-flop 25. The signal level from flip-flop 25 is applied to one input terminal of "AND" gate 27. When the undersize letter reaches gate photocell **74*c* (FIG. 5) upstream but adjacent the undersize letter gate 20*c*, photocell 74*c* goes from light to dark. This condition generates a signal which is applied as a negated input to the other terminal of AND gate 27. The output of this last gate is applied to and energizes the gate solenoid driver 29. The latter actuates the solenoid 31 coupled to the door member of gate 20*c*** opening the latter in time for receiving the undersize letter.

As the trailing edge of the letter passes gate photocell **74*c*, the latter experiences a dark-to-light transition. The enabling signal formerly applied to AND gate 27 is terminated and the solenoid 31 is no longer energized. The door member of the undersize letter gate 20*c*** closes just after the letter has completely entered the gate.

It will be noted that at this time, the gate controller flip-flop 25 remains set. The inadvertent arrival of some document at the gate photocell **74*c* would cause the spurious opening of the gate door. To prevent this occurence, the gate photocell signal generated during the dark-to-light transition is also applied to single shot 33 and triggers the latter to generate a voltage pulse to reset flip-flop 25. This removes the enabling signal on one input terminal of AND gate 27, so that regardless of the signal on its other input terminal supplied by the gate photocell 74*c***, the gate solenoid will not be reactuated.

Similarly, considering the detection of machinable letters, either of two conditions will be present. First, photocells "AD" and "C" of the matrix and "TA" of the thickness sensor will all be light. Second, photocells "D" and "AC" will both be light.

In the first condition, signals from photocells "AD", "C" and "TA", along with the inverted signal (via inverter 35) from OR-gate 21 in the undersize letter detector described hereinbefore are applied to AND-gate 37. The level of this last signal is enabling to AND gate 37 if no undersize letter is present. Assuming this to be the case, AND gate 37 produces an output indicating the detection of a machinable letter. This condition is also indicated by signals from photocells "D" and "AC" in the light state. These signals along with the aforementioned inverted signal from OR gate 21 and a signal from "TA" which is light are applied to AND gate 39, the output of which indicates the presence of a machinable letter. The outputs from AND gates 37 and 39 are OR'ed together in gate 41.

The operation which follows is essentially the same as that described in connection with the undersize letter. The output of OR gate 41 is applied to AND gate 43 and again assuming that no overthick or skew conditions exist, AND gate 43 sets gate controller flip-flop 45 in the set state. The flip-flop applies a signal to one input of AND gate 47. The leading edge of the machinable letter is detected by gate photocell **74*b*, which applies an enabling signal to AND gate 47. Gate solenoid driver 49 is energized and actuates solenoid 51, thereby opening the door of gate 20*b***.

The signal from gate photocell **74*b* at the trailing edge of the document, disables AND gate 47 causing the door of gate 20*b* to close. Additionally, this last signal triggers single shot 53, which in turn resets flip-flop 45**.

Finally, in the case of machinable flats, photocells "E" and "AE" in the matrix and "TB" in the thickness sensor must be light. The signals from these photocells under this condition, tend to enable AND gate 55. This last gate also receives respective inverted inputs from OR gates 21 and 41 in the undersize letter and the machinable letter detectors via inverters 35 and 57.

Assuming that the given document is neither undersized nor a machinable letter, AND gate 55 will produce an output signal indicative of the detection of a machinable flat.

As described in connection with the last two mail categories and assuming no overthick or skew conditions, AND gate 59 is enabled, setting gate-control flip-flop 61. The flip-flop output is applied to AND gate 63. The signal from gate photocell **74*a* upon detection of the leading edge of the document result in an output from AND gate 63 which actuates the gate solenoid driver 65 and consequently, solenoid 67. The door member of gate 20*a* is opened to receive the document. The trailing edge of the machinable flat is detected by gate photocell 74*a* which provides a signal via AND gate 63 to de-energize solenoid 67 and close the gate door. This same signal triggers single-shot 69, which in turn resets flip-flop 61**.

In the preceding examples, it was assumed that the document was neither overthick, nor excessively skewed. With continued reference to FIG. 14, if the document is overthick, photocell "TB" will be dark (refer to FIG. 13C). The negated signal derived therefrom is applied to NOR gate 71, the output of which under the overthick condition, will not enable AND gate 13, which in turn cannot supply an enabling signal to the respective input terminals of AND gates 23, 43 and 59. Thus, regardless of the conditions in the respective detectors, the gate-control flip-flops 25, 45 and 61 will all remain in a reset state and the associated gates will remain closed. The overthick document will continue past the gates, into tray 58.

A similar action takes place in the case of skewed documents. Thus, assume that photocell "A" is covered by the document before a leading edge signal derived from photocell "RT". The negation of the signal generated by photocell "A" during the transition from light-to-dark tends to enable AND gate 73. Subsequently, the signal from photocell "RT" as the latter starts to be covered by the document actuates a leading edge detector 75, which applies an enabling signal pulse to AND gate 73. The output of this AND gate is applied to flip-flop 77, placing it in the set state. The output of this last flip-flop indicates a "skew" condition, which when applied to NOR gate 71, again results in disabling AND gate 13 during the strobe time. As noted hereinbefore, AND gates 23, 43 and 59 are also disabled, the gate-control flip-flops 25, 45 and 61 remain in the reset state, and the gates **20*a*, 20*b* and 20*c*, closed. The skewed documents are deposited in the non-machinable trays 58. Resetting of the skew flip-flop 77 is accomplished in the following manner. As noted earlier, the detection cycle commences with the darkening of the strobe photocell "S". Single shot 11 is triggered and generates a pulse of predetermined duration. The trailing edge of this pulse is used to trigger another single-shot 79 coupled to skew flip-flop 77. The trailing edge of the pulse output of this last single-shot resets flip-flop 77**, and the detection circuit awaits the next document.

Manual Controls and Associated Indicators

Control switches and indicators are provided on a control panel mounted on the control logic cabinet 94. The illuminated pushbutton switches control and indicate power turn-on and motor-power ON-OFF control. Separate indicators are provided to indicate overload conditions.

A maintenance panel which is normally hidden (behind the front door of the logic cabinet) is used only during maintenance modes. The maintenance panel contains a mode switch which can be placed in a "normal" or "maintenance" position. When it is in the "normal" position, all maintenance circuits and switches have no effect on the system's operation. When it is in the "maintenance position", additional switches and logic circuits are enabled. Several of these switches control the transport motors via their solid-state relays. Other switches, in conjunction with logic circuits, enable stepping operation and/or timing loop recycling in those cases where time-out occurs such as where singulation rollers are turned 90° only once.

LED indicators are included throughout the system and provide direct, easy-to-see diagnostic tools in case of a malfunction. For example, there are LED's associated with every photocell amplifier which directly indicate ON/OFF operability of the photocells and their amplifiers by manual movement of an opaque object between the particular photocell and its light module. Once the operation of the photocells and amplifiers is verified, operation of gating solenoids and their drivers may be verified by observing LED's which indicate input signals to the drivers. Operation of the transport motors and associated solid-state relays may be verified using the aforementioned control switches. In cases where further diagnosis is required, LED indicators are located on the logic panels and are used in conjunction with a real or simulated "trial run" and will aid the technician in determining the area of logic which has failed.

Electronics Packaging

As indicated hereinbefore, the electronic circuits utilized in the present system are packaged in an AC load-center cabinet 78, a control logic cabinet 94, and distributed monitor/control subassemblies located adjacent to the particular physical assemblies where monitoring and control takes place.

Reference to the system layout of FIG. 1 indicates that the AC load-center cabinet 78 and control logic cabinet 94 are positioned to enable an operator during control and maintenance modes, to view as much of the overall system's operation as is possible and yet facilitate access to all assemblies for ease of maintenance and fault detection.

SUMMARY

A unique total culling system which satisfies the needs of both flat and letter-size mail processing has been disclosed. The particular system implementation described herein is economical from the standpoint of floor space required for its installation, less than 250 square feet being required with a height dimension of approximately 9½ feet. It should be apparent that the system throughput may be increased by the addition of more mail paths up to the capacity of the inclined conveyor and the ability to divide the mail flow from the conveyor to the multiple paths. Depending upon the application of the system, changes and modifications may be necessary in the individual details taught herein. Such changes and modifications, insofar as they are not departures from the true scope of the invention, are intended to be covered by the claims appended hereto.

What is claimed is:

1. A system for culling and singulating mixed mail pieces including flats comprising in combination:

at least one receiving station, an input conveyor for depositing said mail pieces in said receiving station, a delivery station disposed in contiguity with said receiving station, common transport means linking said receiving station to said delivery station, the portion of said transport means within said receiving station being so situated and having physical dimensions such that it captures a limited number of predetermined types of the mail pieces deposited within said receiving station, and conveys them to said delivery station, said receiving station including means for selectively precluding the capture of any mail pieces by said transport means, a chute disposed below said receiving station for catching those mail pieces not captured by said transport means, means coupling said chute to said input conveyor for continuously recirculating at least a portion of the uncaptured mail pieces to said receiving station, singulator means comprising an inclined slide coupled to said delivery station for receiving the mail pieces furnished to said delivery station by said transport means, said singulator means separating said last mentioned pieces from the other to effect a stream of individual pieces down said slide, a size detection station located along said slide and downstream from said singulator means for measuring the dimensions of said mail pieces and thereby determining the respective mail categories to which they belong, and a plurality of gates under the control of said size detection station for diverting from said stream of mail pieces, those pieces belonging to predetermined categories.

2. A system as defined in claim 1 further including a plurality of take-away conveyors associated respectively with said gates for transporting the mail pieces which enter them to other locations for further processing.

3. A system as defined in claim 2 further characterized in that said means coupling said chute to said input conveyor for the recirculation of mail pieces includes a recycle conveyor for receiving mail from said chute, a gaging roller mounted in proximity to said recycle conveyor and oriented substantially transverse with respect to the conveyor's direction of motion for culling out predetermined types of mail, a cull grate located at an extremity of said recycle conveyor for removing predetermined types of non-machinable mail from the mail flow, and an input hopper interposed between said cull grate and said input conveyor for receiving the mail pieces to be redeposited in said receiving station by the latter conveyor.

4. A system as defined in claim 3 wherein said size detection station includes thickness detector means for providing an electrical signal indicative of the thickness measuring of each mail piece passing through the station.

5. A system as defined in claim 4 further including a first sensor means located in said delivery station for controlling said means within said receiving station for precluding the capture of any mail pieces by said transport means, the control exercised by said first sensor means being a function of the presence and absence of mail pieces within said delivery station.

6. A system as defined in claim 5 further including second sensor means situated in a pre-singulation portion of said singulator means, said second sensor means being responsive to the presence and absence of mail pieces in said pre-singulation section and acting in conjunction with said first sensor means for controlling the motion of said transport means.

7. A system as defined in claim 6 wherein said first and second sensor means are respective photocell assemblies.

8. A system as defined in claim 7 wherein said size detection station includes a matrix of photocell sensors arranged in two banks for independently determining the size of a mail piece respectively in its direction of travel and perpendicular to said direction, logic circuit means for receiving and interpreting the electrical signals generated by said photocell sensors and said thickness detector means, said logic circuit means providing electrical signals for actuating said gates in accordance with the mail categories defined by the interpretations.

9. A system as defined in claim 8 further characterized in that said receiving station and said delivery station have a common inclined backplate and are partially separated from each other by a partition, said transport means being situated at the lower extremity of said common backplate, said partition having an opening adjacent said backplate of sufficient magnitude to permit said transport means to carry edge-oriented mail from said receiving station into said delivery station.

10. A system as defined in claim 9 further characterized in that said transport means comprises a narrow belt which forms a shallow longitudinal shelf along the lower extremity of said receiving station.

11. A system as defined in claim 10 further characterized in that said means within said receiving station for selectively precluding the capture of any mail piece by said transport means comprises a movable vane disposed in the backplate, said vane having its upper extremity hinged along said backplate and its opposite extremity in proximity to said transport belt, said vane being capable of assuming either of two positions in response to electrical signals from said first sensor means, a first of said positions in which said vane is retracted flush with said backplate thereby permitting mail deposited in said receiving station to slide down said backplate and be captured by said transport belt, and a second position in which said lower extremity of said vane is extended outward thereby covering said transport belt and precluding the depositing of any mail thereon.

12. A system as defined in claim 11 further characterized in that said singulator means includes a plurality of spaced-apart singulating stations, each of which stations includes a friction roller and a pair of document sensing means associated therewith, said sensing means being positioned at a pair of respective locations displaced from each other along the length of said slide downstream from said roller, and means under the control of said sensing means for independently controlling the rotation of the roller associated therewith to effect the separation of the mail pieces.

13. A system as defined in claim 12 wherein said singulator means inclined slide is further characterized as having a single registration wall along one side thereof, said slide having a compound slope wherein its longitudinal axis is inclined with respect to the horizontal and its transverse axis is inclined from the horizontal toward said registration wall.

14. A system as defined in claim 13 further including tray means positioned downstream of said gates at the extremity of said slide for receiving mail pieces not belonging to said predetermined categories and hence not accepted by said gates.

15. A system as defined in claim 14 wherein said mail categories accepted by said gates are respectively, machinable flats, machinable letters, and undersize letters, said trays receiving non-machinable mail pieces.

* * * * *